US010217556B2

(12) United States Patent
Groeger et al.

(10) Patent No.: US 10,217,556 B2
(45) Date of Patent: Feb. 26, 2019

(54) FAULT-TOLERANT POWER TRANSFORMER DESIGN AND METHOD OF FABRICATION

(71) Applicant: Carte International Inc., Winnipeg (CA)

(72) Inventors: Joseph H. Groeger, Storrs, CT (US); Ralph Wegner, Winnipeg (CA); Winston Madray, Winnipeg (CA); Garth Norberg, Winnipeg (CA); Brian Klaponski, Winnipeg (CA)

(73) Assignee: Carte International Inc., Winnipeg (CA)

( * ) Notice: Subject to any disclaimer, the term of this patent is extended or adjusted under 35 U.S.C. 154(b) by 0 days.

(21) Appl. No.: 14/931,144

(22) Filed: Nov. 3, 2015

(65) Prior Publication Data

US 2017/0125150 A1 May 4, 2017

(51) Int. Cl.
*H01F 27/10* (2006.01)
*H01F 27/02* (2006.01)
(Continued)

(52) U.S. Cl.
CPC ..... *H01F 27/10* (2013.01); *H01F 27/02* (2013.01); *H01F 27/025* (2013.01); *H01F 27/24* (2013.01); *H01F 27/2823* (2013.01)

(58) Field of Classification Search
CPC ..... H01F 27/10; H01F 27/12; H01F 27/02
See application file for complete search history.

(56) References Cited

U.S. PATENT DOCUMENTS 922,909 A 5/1909 Jensen
4,453,197 A * 6/1984 Burrage ..... H01F 27/02 174/17 LF (Continued)

FOREIGN PATENT DOCUMENTS

DE 10010737 A1 * 9/2001 ..... F28D 1/03
GB 922909 10/1960
WO 01/63629 8/2001

OTHER PUBLICATIONS

DE10010737A1, Machine Translation, Sep. 2001.*

*Primary Examiner* — Elvin G Enad
*Assistant Examiner* — Malcolm Barnes
(74) *Attorney, Agent, or Firm* — Carmody Torrance Sandak & Hennessey LLP

(57) ABSTRACT

A transformer system for containing energy resulting from a sudden generation of gases which increases the pressure inside a transformer tank. The system comprises a) a transformer tank for housing a transformer coil and core assembly therein, and containing a dielectric fluid that is capable of electrically insulating components of the transformer coil and core assembly; and b) at least one heat exchanger connected to the transformer tank, wherein the at least one heat exchanger comprises at least one hollow panel or radiator. As the dielectric fluid increases in temperature and expands within the tank, the dielectric fluid is cooled by circulating the dielectric fluid through the at least one hollow panel or radiator in the at least one heat exchanger. The transformer tank and the at least one heat exchanger are capable of expanding in volume to contain energy resulting from the sudden generation of gases which increases the pressure inside the transformer tank.

23 Claims, 7 Drawing Sheets

(51) Int. Cl.
*H01F 27/24* (2006.01)
*H01F 27/28* (2006.01)

(56) References Cited

U.S. PATENT DOCUMENTS

| | | | | |
|---|---|---|---|---|
| 4,745,966 | A * | 5/1988 | Avery | H01F 27/025 336/58 |
| 6,726,857 | B2 * | 4/2004 | Goedde | H01F 27/12 252/570 |
| 7,530,383 | B2 | 5/2009 | Munroe et al. | |
| 8,717,134 | B2 | 5/2014 | Pintgen et al. | |
| 8,884,732 | B2 | 11/2014 | Johnson et al. | |
| 2009/0072940 | A1 * | 3/2009 | Yang | H01F 27/14 336/57 |
| 2010/0065261 | A1 | 3/2010 | Pintgen et al. | |
| 2010/0065306 | A1 * | 3/2010 | Pintgen | H01F 27/02 336/90 |
| 2010/0133284 | A1 * | 6/2010 | Green | H01F 27/14 220/721 |
| 2011/0273255 | A1 * | 11/2011 | Thompson | H01F 27/02 336/94 |
| 2012/0007707 | A1 * | 1/2012 | Matai | H01F 27/02 336/90 |
| 2012/0216393 | A1 * | 8/2012 | Ballard | H01F 27/02 29/602.1 |
| 2012/0242443 | A1 * | 9/2012 | Magnier | H01F 27/14 336/90 |
| 2013/0187739 | A1 * | 7/2013 | Sullivan | H01F 27/025 336/90 |
| 2014/0218148 | A1 | 8/2014 | Pintgen et al. | |
| 2014/0266529 | A1 * | 9/2014 | Kendrick | H01F 27/14 336/105 |
| 2014/0374068 | A1 * | 12/2014 | Zeng | H01F 27/10 165/104.33 |
| 2015/0070869 | A1 * | 3/2015 | Gaard | H01F 27/14 361/836 |
| 2015/0188297 | A1 * | 7/2015 | Boe | H01F 27/14 174/564 |
| 2016/0107795 | A1 * | 4/2016 | Brodeur | B65D 25/20 336/58 |
| 2016/0118186 | A1 * | 4/2016 | Frimpong | G01H 1/00 307/119 |
| 2017/0279251 | A1 * | 9/2017 | Leber | H01F 27/02 |

* cited by examiner

FAULT-TOLERANT POWER TRANSFORMER DESIGN AND METHOD OF FABRICATION

FIELD OF THE INVENTION

The present invention relates generally to safety and risk management improvements in power transformers used for transmission and distribution of electrical power.

BACKGROUND OF THE INVENTION

Transformers are electrical devices used to transfer electrical power from one circuit to another. Transformers are used extensively in the transmission and distribution of electrical power, both at the generating end and the consumer's end of the power distribution system. Such transformers include distribution transformers that convert high-voltage electricity to lower voltage levels acceptable for use for commercial and residential customers. These include network transformers that supply power to grid-type or radial secondary distribution systems in areas of high load density. These areas of high load density include, for example, underground, metropolitan vault applications, government, commercial, institutional and industrial facilities, and office towers and skyscrapers. Network transformers typically receive power at a higher distribution voltage and provide electric power at a lower voltage to a secondary network.

Transformers can be categorized in various ways, including the type of insulation (liquid immersed or dry-type), number of phases (single-phase or multi-phase), voltage level, or capacity. In addition, in the case of network transformers, transformers can be classified based on their type of installation. For example, "vault-type" network transformers are designed for installation in below-ground vaults, where occasional submersion may occur. On the other hand, "subway-type" network transformers are designed for installation in subsurface vaults, where frequent or continuous submerged operation is likely. Subway designs may also be used in vault-type applications.

Transformers are typically configured to include a core and conductors that are wound around the core so as to form at least two windings (or coils). These windings or coils are installed concentrically around a common core of magnetically suitable material such as iron and iron alloys and are electrically insulated from each other. The primary winding or coil receives energy from an alternating current (AC) source. The secondary winding receives energy by mutual inductance from the primary winding and delivers that energy to a load that is connected to the secondary winding. The core provides a circuit for the magnetic flux created by the alternating current flowing in the primary winding and which includes the current flow in the secondary winding. The core and windings are typically retained within an enclosure or tank for safety and to protect the core and coil assembly from damage. The tank also provides a clean environment, free of moisture. The tank is typically filled with an insulating fluid that provides electrical insulation value, while also serving to conduct heat from the core and coil assembly to the tank surface or cooling panels.

Although transformers are designed to operate efficiently at extreme temperatures, including relatively high temperatures, excessive heat is detrimental to transformer life. Transformers, similar to other electrical equipment, contain electrical insulation, which is used to prevent energized components or conductors from contacting or arcing over to other components, conductors, structural members or other internal circuitry. Heat degrades insulation, causing it to lose its ability to perform its intended insulative function. Additionally, the higher the temperatures experienced by the insulation, the shorter the service life of the insulation. When insulation fails, an internal fault or short circuit may occur, which can cause the equipment to fail and may lead to system outages. Transformer arcing faults result in the sudden generation of gases from oil vaporization and decomposition, which increases the pressure inside the transformer tank. Arcing faults may also arise from failures of other components including grounding switches, tap changers, bushings, ground connections, and electrical cable connections thereto.

Catastrophic rupture of a transformer can occur when the pressure generated by the gases exceeds the rupture pressure limit of the transformer tank or any component thereof. Although extremely rare, such ruptures can result in the release of flaming gases and liquids, which can pose a hazard to the surrounding area as well as pollute the environment. A catastrophic rupture can also cause expulsion of hardware and components from the transformer. Thus, it is critical that temperatures in the transformer be maintained at an acceptable level and/or that other steps are taken to minimize any risk that may result from such catastrophic failure.

As described herein, transformers generally contain an electrical insulator, which may, for example, be of a "dry-type" solid or gaseous dielectric or a liquid dielectric coolant to prevent excessive temperature rise and premature transformer failure. Most commonly, transformers are provided with a liquid coolant to dissipate the heat generated during normal transformer operation and to electrically insulate the transformer components. This liquid coolant is often referred to as a dielectric fluid or oil and is selected based on properties that affect its ability to function effectively and reliably, including, but not limited to, flash and fire point, heat capacity, viscosity over a range of temperatures, impulse breakdown strength, gassing tendency, and pour point. Examples of these coolants include, but are not limited to dimethyl silicone, mineral oils, hydrocarbon oils, synthetic hydrocarbon oils, paraffinic oils, naphthenic oils, ester and other plant-derived fluids, among others. Examples of transformers using a liquid coolant to dissipate heat are described, for example, in U.S. Pat. No. 6,726,857 to Goedde et al., U.S. Pat. No. 8,717,134 to Pintgen et al., and in U.S. Pat. Pub. No. 2010/0133284 to Green et al., the subject matter of each of which is herein incorporated by reference in its entirety.

Network transformers are designed for continuous use for a number of years and with minimal oversight. In many instances these network transformers are not routinely checked or maintained. In long-term usage, corrosion resistance is of great concern. Network transformers often sit in a network vault such as in a basement of a building or in a vault beneath a sidewalk or roadway that may be occasionally or routinely flooded. Corrosion has been cited as causing 80% or more of transformer failures on certain utility systems.

For example, the transformer system described in U.S. Pat. No. 8,717,134 to Pintgen uses a weakened weld 40 that is positioned in the lowest point of the transformer cooling panel, which is the most flood-prone and thus at the greatest risk of corrosion damage. As seen in FIGS. 1-3, as this weakened weld 40 degrades, the release of internal fluid cannot be controlled. Additionally, because corrosion is an electrochemical process, sharp corners, such as in the corner of the transformer cooling panel, concentrate the electrochemical stress which enhances the corrosion effect and increases the risk of the tank developing a leak and releasing fluid to the environment. Oil loss without a preceding electrical fault event will directly lead to electrical failure of the core and coil assembly and a possible fire. A further deficiency to this configuration is that in a catastrophic event, spacers 38 securing the cooling panel(s) 14 to the transformer tank 12 detach to create additional volume to increase the amount of gas that the tank 12 and cooling panel(s) 14 can withstand without rupturing. However, this additional volume resulting from the buildup of fluid prior to release, as shown in FIGS. 2 and 3, may cause the transformer system to become wedged in the containment vault, making removal and repair of the damaged system more difficult.

U.S. Pat. No. 8,884,732 to Johnson et al., the subject matter of which is herein incorporated by reference in its entirety, describes a dry-type network transformer having a core and coil assembly insulated by a combustion-inhibiting gas. The combustion-inhibiting gas and core and coil assembly are disposed within a hermetically sealed enclosure that is encapsulated by a polymer sealant. The combustion-inhibiting gas comprises air, an inert gas or a mixture of gases and is maintained at a prescribed temperature and pressure to prevent the operating temperature of the transformer from exceeding 220° C.

However, dry-type network transformers such as those described by Johnson are believed to be unable to adequately contain the energy released during an internal arc fault event.

Thus, while various methods have been proposed for improving the pressure containment capabilities of a transformer tank, additional improvement means are still desired to provide a transformer tank that is able to adequately contain extreme pressures of gases therein. In addition, it is also desirable to provide an improved means of selectively and preferentially venting these gases and fluid from the transformer tank to prevent the tank from rupturing in a catastrophic manner under extreme electric fault energy conditions that exceed the containment pressure limit of the improved transformer design. Finally, it is also desirable to provide an improved pressure containment system that does not cause significant distortion of the outer dimensions of the transformer tank system that would cause the tank to become wedged in the containment vault.

SUMMARY OF THE INVENTION

It is an object of the present invention to provide a transformer tank that is capable of containing energy.

It is another object of the present invention to provide a transformer system that is capable of containing a catastrophic event.

It is another object of the present invention to provide a transformer system that is capable of preferentially venting excessive pressures from within the transformer tank.

It is still another object of the present invention to provide an improved network transformer.

It is another object of the present invention to provide a transformer system having no inherent corrosion susceptibility.

It is still another object of the present invention to provide a transformer system capable of containing energy while maintaining integrity of the components in the system.

It is still another object of the present invention to provide a transformer system that does not cause significant distortion of the outer dimensions of the transformer tank system that would lead to the tank system becoming wedged in the containment vault.

To that end, in one embodiment, the present invention relates generally to a transformer system comprising:

a) a transformer tank, wherein the transformer tank comprises a plurality of sidewall members, a tank cover, and a bottom member joined together to form an enclosure for housing a transformer coil and core assembly therein, and wherein the enclosure contains a dielectric fluid that is capable of electrically insulating components of the transformer coil and core assembly; and b) at least one heat exchanger connected to the transformer tank, wherein the at least one heat exchanger comprises at least one panel or radiator;

wherein as the dielectric fluid increases in temperature and expands within the tank, the dielectric fluid is cooled by circulating the dielectric fluid through the at least one panel or radiator in the at least one heat exchanger; and wherein, the transformer tank and the at least one heat exchanger are capable of expanding in volume to contain energy resulting from a sudden generation of gases which increases the pressure inside the transformer tank.

In another embodiment, the present invention also relates generally to a heat exchanger for a transformer system, wherein the heat exchanger is capable of circulating dielectric fluid as the dielectric fluid increases in temperature and expands within a transformer tank, wherein the heat exchanger comprises:

a hollow panel comprising a first side and a second side, wherein the second side of the hollow panel is connected to the transformer tank at a plurality of ports, wherein heated dielectric fluid circulates into the heat exchanger from the transformer tank through a first port and cooled dielectric fluid exits the heat exchanger through a second port back to the transformer tank;

wherein the hollow panel is capable of expanding in volume to contain energy resulting from a sudden generation of gases which increases pressure inside the heat exchanger, and wherein the heat exchanger comprises a plurality of constraints, said plurality of constraint being capable of minimizing deformation of the heat exchanger when the heat exchanger expands in volume.

In another embodiment, the present invention also relates generally to a heat exchanger for a transformer system, wherein the heat exchanger is capable of circulating dielectric fluid as the dielectric fluid increases in temperature and expands within a transformer tank, wherein the heat exchanger comprises:

a hollow panel comprising a first side and a second side, wherein the second side of the hollow panel is connected to the transformer tank at a plurality of ports, wherein heated dielectric fluid circulates into the heat exchanger from the transformer tank through a first port and cooled dielectric fluid exits the heat exchanger through a second port back to the transformer tank;

wherein the hollow panel is capable of expanding in volume to contain energy resulting from a sudden generation of gases which increases pressure inside the heat exchanger, and wherein the heat exchanger comprises a preferred release notch on a lower edge of the hollow panel, wherein the first side and the second side of the hollow panel are notched on a lower edge thereof and a wedge piece is welded between the notched edge of the first side and the second side, wherein when the dielectric fluid becomes pressurized inside the heat exchanger and exceeds a rupture pressure of the heat exchanger, a rupture of the heat exchanger will preferentially initiate at the preferred release notch of the heat exchanger.

In still another embodiment, the present invention also relates generally to a rupture resistant system comprising:

a) a tank comprising a plurality of sidewall members, a tank cover and a bottom member joined together to form an enclosure capable of containing a fluid therein; and b) at least one heat exchanger connected to the tank, wherein the at least one heat exchanger comprises at least one hollow panel;

wherein as the fluid in the tank increases in temperature and expands within the tank, the fluid is cooled by circulating the fluid through the at least one hollow panel in the at least one heat exchanger; and wherein, the tank and the at least one heat exchanger are capable of expanding in volume to contain energy resulting from a sudden generation of gases which increases the pressure inside the tank.

BRIEF DESCRIPTION OF THE FIGURES

For a fuller understanding of the invention, reference is made to the following description taken in connection with the accompanying figures, in which.

Also, while not all elements may be labeled in each figure, all elements with the same reference number indicate similar or identical parts.

DETAILED DESCRIPTION OF THE PREFERRED EMBODIMENTS

In order to provide a clear and consistent understanding of the invention described herein, the following definitions are provided:

A transformer is defined as a device used to transfer electrical power from one circuit to another.

A network transformer is defined as a transformer that supplies power to radial or grid-type secondary distribution systems in an area of high load density; not routinely inspected or monitored.

An interconnected transformer is defined as two or more transformers that are connected in parallel. Thus, a fault in one transformer can also cause a fault in the other interconnected transformers due to electric energy backfeed from the network.

A transformer rating is defined as the capacity of a transformer to transmit power from one circuit to another and is limited by the permissible temperature rise during operation. The rating of a transformer depends on the load needed for the network and is generally expressed as a product of the voltage and current limits of one of the windings and is expressed in thousand volt-amperes or kVA. The kVA rating of a transformer indicates the maximum power for which the transformer is designed to operate with a permissible temperature rise and under normal operating conditions. In the case of network transformers, the capacity depends in part on the load required for the network, which may be rated, for example, at 500 kVA, 750 kVA, 1,000 kVA, or 2,500 kVA, depending on the size of the network. Other kVA ratings would also be known to those skilled in the art.

The permissive temperature rise during operation is defined as the maximum working temperature increase of the transformer during operation.

The transformer rupture pressure is defined as the maximum pressure of the gases within the transformer tank at which point the transformer system will rupture or breach.

An event is defined as an internal unintended electrical event that results in a high energy release. This event causes breakdown of the insulating materials that, in turn, produces a high relative volume of gaseous compounds. This volume is prevented from expansion due to the physical constraints of the tank. A catastrophic event results from a high pressure-induced rupture of the tank.

A preferred release is defined as a feature that allows a tank to release internal pressure under an extreme condition that is beyond the very high pressure margin already designed into the tank. The preferred release point is designed to vent pressure from the base of one or more cooling panels, at an energy level between 10 megaJoules (MJ) and 25 MJ electric arc energy.

Figure 4:
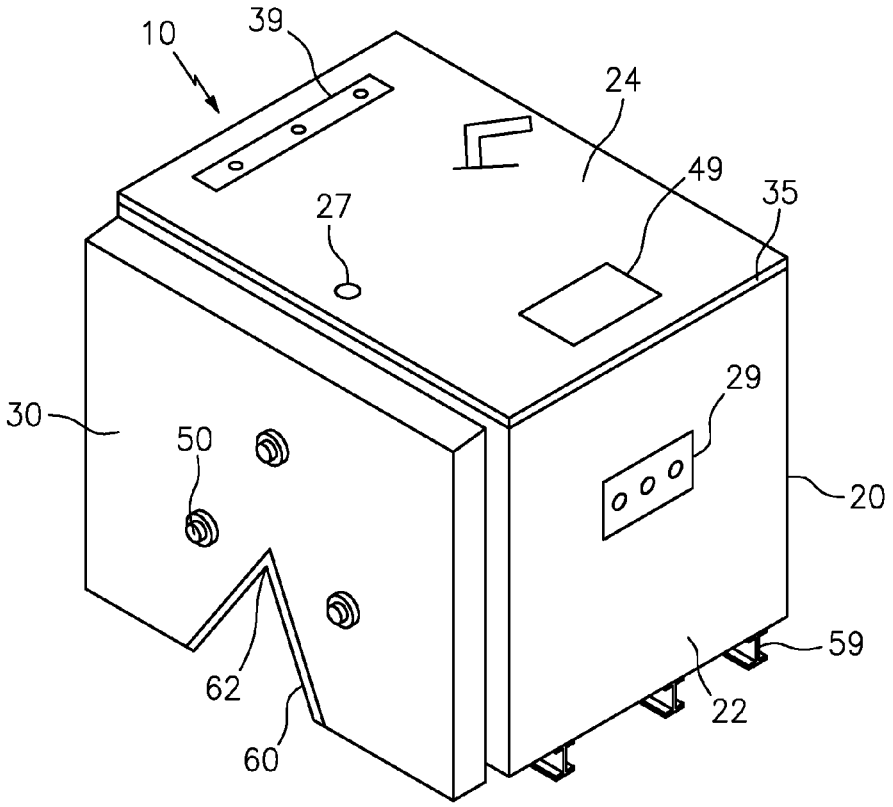
FIG. 4 depicts a view of a transformer system in accordance with an embodiment of the present invention.

In one embodiment, and as seen in FIG. 4, the present invention relates generally to a transformer system 10 comprising:

a) a transformer tank 20, wherein the transformer tank 20 comprises a plurality of sidewall members 22, a tank cover 24, and a bottom member 26 joined together to form an enclosure for housing a transformer coil and core assembly therein, and wherein the enclosure contains a dielectric fluid that is capable of electrically insulating components of the transformer coil and core assembly; and b) at least one heat exchanger 30 connected to the transformer tank, wherein the at least one heat exchanger 30 comprises at least one panel or radiator;

wherein as the dielectric fluid increases in temperature and expands within the tank, the dielectric fluid is cooled by circulating the dielectric fluid through the at least one panel or radiator in the at least one heat exchanger; and wherein, the transformer tank 20 and the at least one heat exchanger 30 are capable of expanding in volume without rupture to contain energy resulting from a sudden generation of gases which increases the pressure inside the transformer tank 20.

The plurality of side members 22, tank cover 24 and bottom member 26 are preferably joined together by welding. However, it is also contemplated that one or more of the side members 22, tank cover 24 and bottom member 26 may be constructed of a single piece of material. Thus, for example, one or more of the side members 22 may comprise a single piece of material the ends of which are joined together via welding. What is most important is that the method of joining the one or more side members 22, tank cover 24 and bottom member 26 together must create a pressure-tight, strong, yet ductile bond that is also capable of fully containing an event resulting from the catastrophic, sudden generation of gases within the transformer tank 20.

The transformer system 10 comprising the transformer tank 20 and cooling panel 30 described herein is desired to have an expansion volume of at least 15%, and more preferably at least 30%, to provide for absorption of energy from a catastrophic event. It is also critical that the transformer tank 20 be capable of thermal expansion and contraction in a uniform and controlled manner without rupturing. Finally, it is desired that the transformer tank 20 described herein exhibit improved elasticity due to improved methods of welding, fabrication, and structural design.

In a preferred embodiment, the sidewalls 22 and the tank cover 24 are capable of expanding in volume to contain the energy resulting from the sudden generation of gases. In addition, the bottom member 26 is rigid and does not flex significantly when the transformer tank 20 and the at least one heat exchanger 30 expand in volume. The bottom member 26 may further comprise I-beams or other structural members 59 welded thereto, in the orientation shown in FIG. 4 or another orientation, to support the tank 20 and provide rigidity. Other means of supporting the tank and providing rigidity may also be used.

The plurality of side members 22, tank cover 24 and bottom member 26 may be constructed of various materials including, for example, stainless steel, carbon steel, and aluminum alloys. While other materials may also be usable in the practice of the invention, what is most important is that the material(s) has(ve) suitable strength, structural integrity, ductility, and impact resistance to expand as is necessary to contain a catastrophic event. In addition, the material must also demonstrate good weldability so that there is no fault that occurs along a weld seam if the transformer tank and radiator(s) must expand to contain the catastrophic event.

Suitable carbon steels include, for example, copper-bearing low carbon grade carbon steels such as ASTM A36 or similar.

While various stainless steels may be used in the practice of the invention, preferred grades of stainless steel include, but are not limited to, ASTM Grade 316 and Grade 316L. Grade 316 is the standard molybdenum-bearing grade. The presence of molybdenum in the Grade 316 stainless steel provides good overall corrosion resistance properties as well as high resistance to pitting and crevice corrosion in chloride environments. Grade 316L is the low carbon version of 316 and is generally immune from sensitization (i.e., grain boundary carbide precipitation). Thus Grade 316L is often used in heavy gauge welded components (over about 6 mm). Grade 316L offers higher creep, stress to rupture and tensile strength at elevated temperatures as compared with chromium-nickel austenitic stainless steels.

It is desired that the yield strength of the material be within the range of about 30 kilopounds per square inch (ksi) to about 40 ksi (about 206 MPa to about 276 MPa), that the tensile strength of the material be within the range of about 45 ksi to about 80 ksi (about 310 MPa to about 550 MPa), and that the elongation limit is between about 20% and about 60%.

Figure 5B:
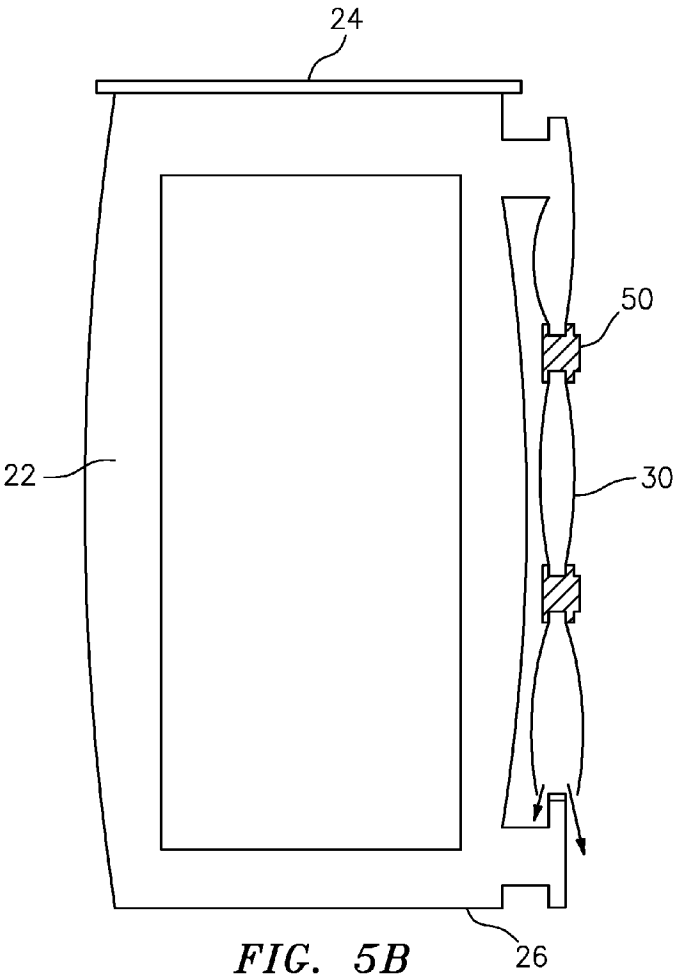
FIGS. 5A and 5B depict views of the transformer tank and a heat exchanger, before and after internal pressurization showing the preferred release path in accordance with the present invention.
Figure 5A:
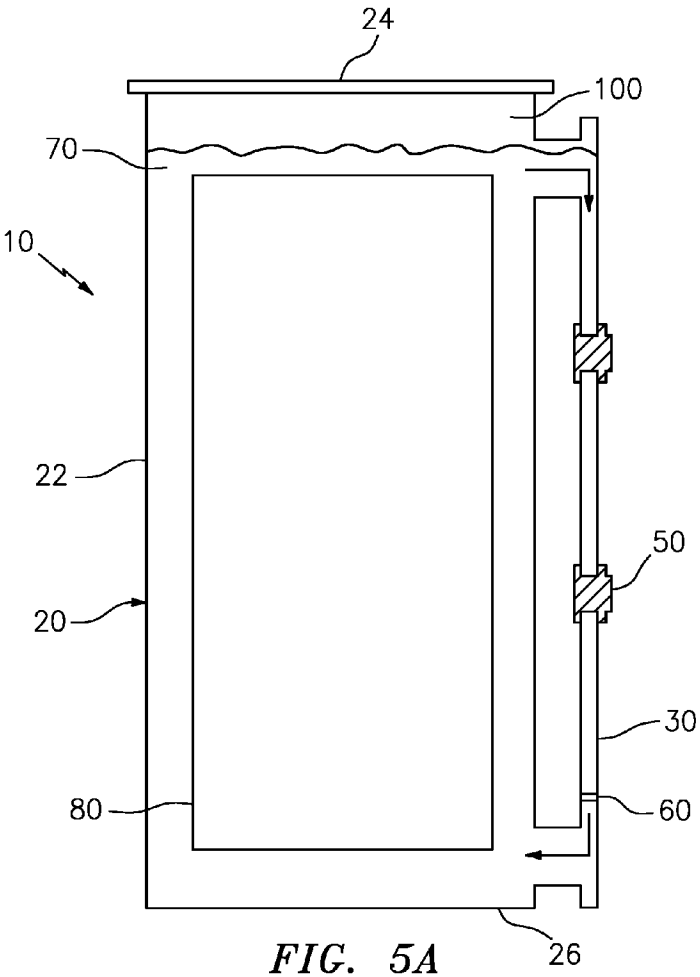

As shown in FIG. 5A, the enclosure contains a dielectric fluid 70 disposed therein that is capable of electrically insulating components of the transformer core and coil assembly 80. The dielectric fluid 70 is contained within a compressible headspace 100.

The transformer tank 20 is sealed closed by tank cover 24. The core and coil assembly 80 comprises a magnetic core on which is wound a low voltage winding and a high voltage winding. The line end of the low voltage winding is connected by conductors to low voltage bushings 29 and the line end of the high voltage winding is connected by conductors to high voltage bushings 39 that are mounted in the cover 24. The tank cover 24 may also contain one or more welded access panels 49.

As the coil and core assembly 80 becomes heated, heat is transferred to the surrounding dielectric fluid 70, causing the fluid 70 to expand within the tank 20. Thus, when the dielectric fluid 70 inside of the tank 20 increases in temperature and expands within the tank 20, the dielectric fluid 70 can be cooled by circulating the dielectric fluid 70 through the radiator or heat exchanger 30 as shown by the arrows in FIG. 5A.

The one or more radiators or heat exchangers 30 attached to the tank 20 cool the hot fluid that rises to the top of the tank 20 by circulating the fluid through the one or more radiators or heat exchangers 30 and returning the now cooled fluid at the bottom of the tank 20. The one or more radiators or heat exchangers 30 provide additional cooling surfaces beyond those provided by the tank walls alone. Optionally, fans (not shown) may be provided to force a current of air to blow across the heated transformer enclosure, or across radiators or tubes to increase the transfer of heat from the hot fluid and heated tank to the surrounding air.

Radiators are the most common type of heat exchanger used for circulating and cooling dielectric fluids in a transformer. Various shapes and configurations of radiators can be used and depending on the size and shape of the transformer, more than one heat exchanger may be used. One common type of radiator is a panel-type radiator in which a plurality of metal panels are stacked together to form a radiator unit. To achieve cooling, air flows vertically across the radiator panels to conduct heat away from the dielectric fluid. Another configuration that may be used is a tube-type radiator that may comprise carbon steel tubes welded into a pipe header. Other configurations of radiators or heat exchangers are also usable in the present invention and would be known to those skilled in the art.

The dielectric fluid 70 must be able to effectively and reliably perform its cooling and insulating functions for the service life of the transformer that, for example, may be up to 40 years (or more). The ability of the fluid 70 and the transformer 10 to dissipate heat must be such as to maintain an average temperature rise below a predetermined maximum at the transformer's rated kVA. The cooling system must also prevent hot spots or excessive temperature rise in any portions of the transformer. In the transformer system 10 described herein, this can be accomplished by submerging the core and coil assembly 80 in the dielectric fluid 70 and allowing free circulation of the fluid 70. The dielectric fluid at least substantially covers and surrounds the core and coil assembly 80.

A compressible head space 100 is provided in the top of the enclosure to allow for thermal expansion and contraction of the dielectric fluid 70 within the enclosure. In one embodiment, the tank enclosure is evacuated to remove oxygen then sealed and pressurized with nitrogen or another inert gas to reduce flammability. A fill valve 27 may be provided in the tank cover 24 so that the dielectric fluid 70 can be sampled for periodic chemical analysis.

The flash and fire point of the dielectric fluid, as determined by ASTM D-92, are critical properties of a dielectric fluid. The flash point represents the temperature of the dielectric fluid that will result in an ignition of the dielectric fluid vapors when exposed to air and an ignition source. The fire point represents the temperature of the dielectric fluid at which sustained combustion occurs when exposed to air and an ignition source. The flash point of the dielectric fluid usable in the present invention is preferably at least about 145° C. to provide reasonable safety against the various hazards inherent with low flammable fluids. Fluids intended for high fire point applications may have a fire point of at least about 300° C.

The viscosity of a dielectric fluid at various temperatures is another important factor in determining its effectiveness because dielectric fluids cool the transformer by convection. Viscosity is a measure of the resistance of a fluid to flow, and the dynamic flow of a dielectric coolant is typically discussed in terms of its kinematic viscosity, which is measured in Stokes and is often referred to merely as "viscosity." With other factors being constant, at lower viscosities, a dielectric fluid provides better internal fluid circulation and better heat removal. Organic molecules having low carbon numbers tend to be less viscous, but reducing the overall carbon number of an oil to reduce its viscosity also tends to significantly reduce its fire point. The desired dielectric fluid possesses both an acceptably low viscosity at all temperatures within a useful range and an acceptably high fire point. A preferred dielectric coolant will have a viscosity at 100° C. of less than about 15 centiStokes (cS), and more preferably, less than about 12 cS.

The gassing tendency of a dielectric fluid is another important factor in its effectiveness. Gassing tendency is determined by applying a 10,000 volt AC current to two closely-spaced electrodes, with one of the electrodes being immersed in the transformer fluid under a controlled hydrogen atmosphere. The amount of pressure elevation in the controlled atmosphere is an index of the amount of decomposition resulting from the electrical stress that is applied to the liquid. A pressure decrease is indicative of a liquid that is stable under corona exposure and is a net absorber of hydrogen.

Other important properties of dielectric fluids include a fluid's dielectric breakdown strength at 60 Hz, which indicates its ability to resist electrical breakdown at power frequency, a fluid's impulse dielectric breakdown voltage, which indicates its ability to resist electrical breakdown under transient voltage stresses such as lightning and power surges, and the dissipation factor of a fluid, which is a measure of the dielectric losses in that fluid. A low dissipation factor indicates low dielectric losses and a low concentration of soluble, polar contaminants.

Based thereon, and as described herein, suitable dielectric fluids for use in the transformers described herein include those fluids that are electrically insulating and that can provide good cooling capabilities over a long period of time. Such dielectric fluids include, but are not limited to, mineral oils, which, if desired, may be purified to improve its electrical properties, flame resistant silicone oils, such as dimethyl silicone, hydrocarbon oils, synthetic hydrocarbon oils, synthetic ester fluids, natural esters fluids, Envirotemp FR3®, which is an ester fluid derived from renewable vegetable oils (available from Cargill, Inc.), as well as the dielectric fluids described in U.S. Pat. No. 6,726,857 to Goedde et al., the subject matter of which is herein incorporated by reference in its entirety. Mineral oils may also be treated in a manner that selectively removes the low molecular weight fractions thereof, thus increasing the flash point. In a preferred embodiment, the dielectric fluid comprises mineral oil or FR3®. FR3® has a higher flashpoint and lower flammability than most mineral oils and thus has been shown to be suitable for use as a dielectric fluid in the present invention.

In addition, moisture, oxygen and environmental pollutants detrimentally affect the characteristics of dielectric fluids. Specifically, moisture reduces the dielectric strength of the fluid, while oxygen helps form sludge. Sludge is formed primarily due to the decomposition of mineral oil resulting from the oil's exposure to oxygen in the air when the fluid is heated.

Due to changes of temperature within the transformer enclosure, the volume of the headspace and of the fluid in the transformer tank will change. Thus, to prevent a negative internal pressure that might draw moisture into the main tank, the gas space above the insulating fluid may be pressurized with dry nitrogen to a pressure of 2-10 PSIG (0.14-0.69 bars).

Figure 1:
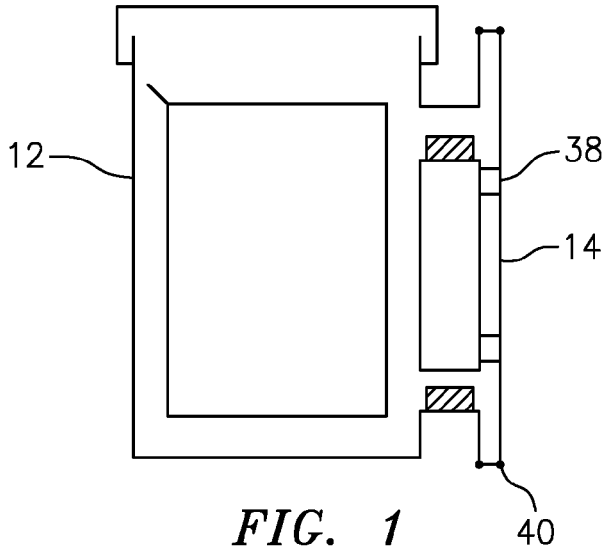
FIG. 1 (PRIOR ART)
FIG. 1 depicts a view of a prior art transformer system under normal operating conditions.
Figure 2:
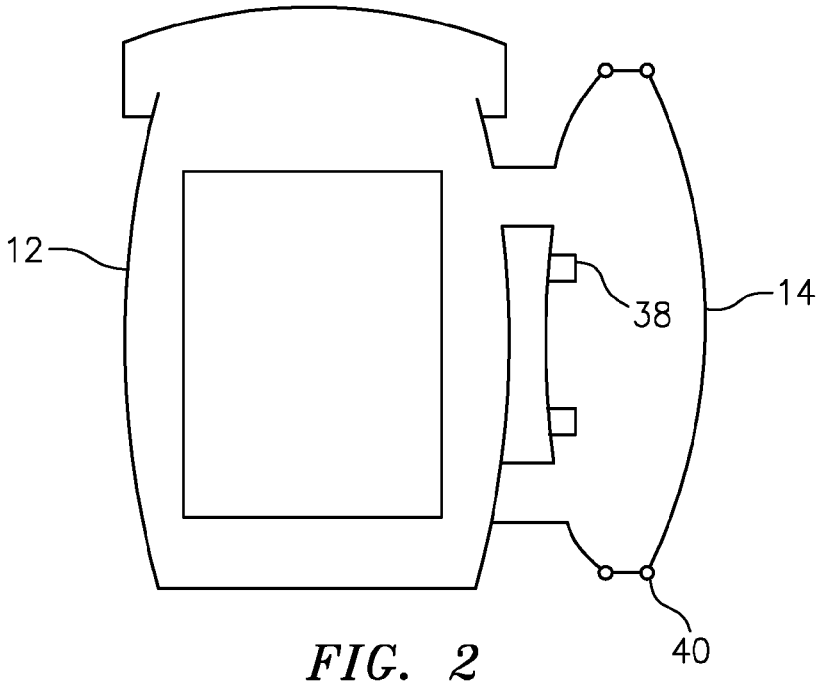
FIG. 2 (PRIOR ART)
FIG. 2 depicts another view of the prior art transformer system under increased pressure conditions.
Figure 3:
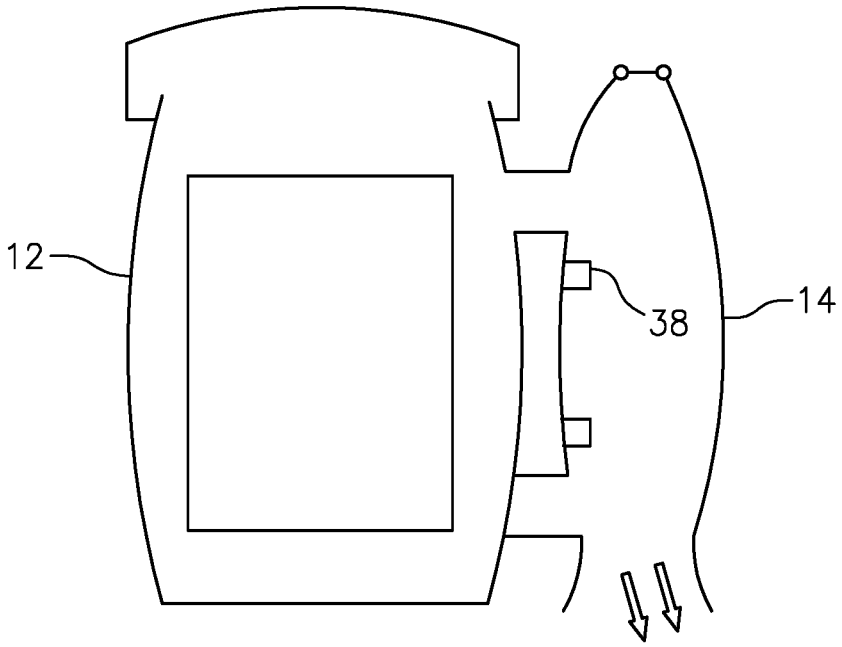
FIG. 3 (PRIOR ART)
FIG. 3 depicts another view of the prior art transformer system venting pressure under excessive pressure conditions.

In another embodiment of the present invention, the one or more heat exchangers further comprise constraints to limit or minimize deformation of the heat exchanger. Thus, as seen in FIG. 2, these constraints may comprise a plurality of rivets 50 that are spaced apart from each other along the length of the heat exchanger. The result is that elastic and plastic deformation of the one or more heat exchangers is limited or constrained. The spacing and geometry of the rivets 50 is such that the plates of the one or more heat exchangers 30 can still deform in a manner that increases the internal volume thereby containing a catastrophic or other internal pressurizing event. However, the degree of flexing is limited by the rivets 50. Thus, unlike in U.S. Pat. No. 8,717,134 to Pintgen, the rivets 50 of the heat exchanger 30 in the present invention are not designed to yield or detach upon increased pressure and thus the system of the present invention is capable of principally maintaining the shape/structure and integrity of the heat exchanger, even during a catastrophic event.

The plurality of rivets 50 preferably comprise at least two rivets 50 and more preferably comprise at least three or more rivets 50. The rivets are arranged about the heat exchanger 30 and the spacing and geometry of the rivets is designed to concentrate mechanical stresses. The placement of the rivets is optimized based on the design of the heat exchanger panel as well as the material of the system (i.e., carbon steel, stainless steel, aluminum, etc.). For example, if the cooling panels of the heat exchanger 30 contain a preferred release point 60, as described in more detail below, the rivets 50 are arranged to concentrate mechanical stresses at a tip or apex of the notch. In other instances, if the transformer system 10 does not contain a preferred release point, the rivets may be arranged in pairs or in a pattern of three or four rivets that are symmetrically spaced.

The transformer system 10 contains at least one heat exchanger 30 and depending on the size of the configuration may comprise at least two or more heat exchangers 30. However, it is generally preferred that all of the heat exchangers 30 in the transformer system 10 contain rivets to minimize the degree of flexing of the heat exchanger 30.

Figure 6:
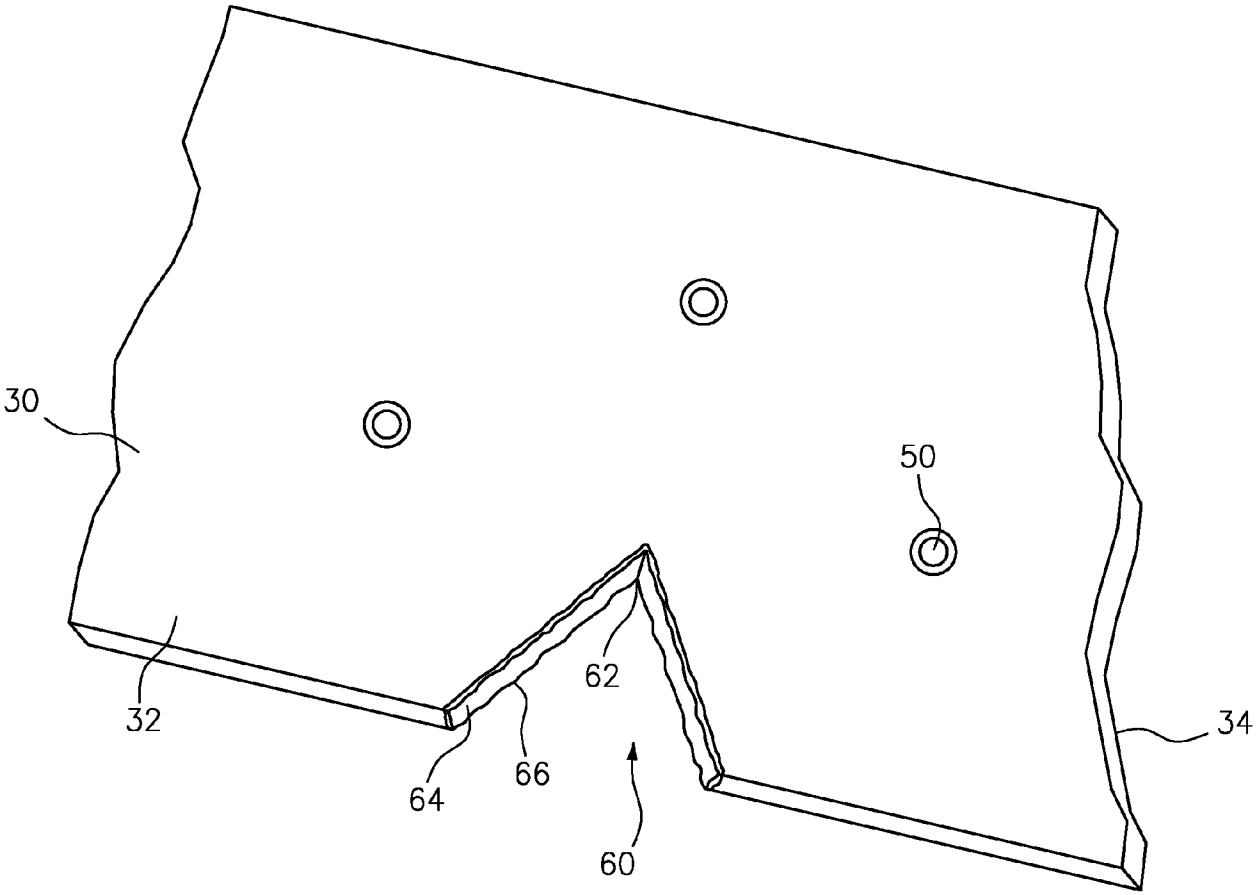
FIG. 6 depicts a view of one embodiment of a heat exchanger of the present invention having a preferred release notch.

In another embodiment, the transformer system 10 further comprises a preferred release notch 60. Thus, during a catastrophic event in which the dielectric fluid becomes heated and hot gases are produced that exceed the rupture pressure of the transformer tank 20, the transformer tank 20 can vent so that the hot oil and gases can be released in a controlled fashion to avoid catastrophic rupturing of the transformer tank 20. As best shown in FIG. 6, this preferred release notch 60 comprises a stainless steel wedge piece 64 that is welded to notched cooling panels 32 and 34 of heat exchanger 30 with stainless steel weld material 66.

The stainless steel wedge piece 64 is welded between the first panel 32 and the second panel 34 of the heat exchanger 30. The spacing and geometry of the rivets 50 is designed to concentrate mechanical stresses at a tip or apex 62 of the preferred release notch 60. Thus, any rupture will initiate at the tip or apex 62 of the preferred release notch 60 and then propagate along the sides of the preferred release notch 60 along the seam of the weld 66. Thus, the preferred release notch 60 of the present invention provides a progressive opening that can release pressure with a small opening at the apex 62 of the release notch 60, which can gradually widen, if necessary, if the pressure intensifies.

The geometry of the preferred release notch 60 can be controlled to effect a range of release pressures. However the angle of the preferred release notch 60 is preferably within a range of about 30 to about 70 degrees, more preferably between about 50 and about 60 degrees. In addition, the height of the preferred release notch 60, as measured from the base of the cooling panel of the heat exchanger 30, is preferably between about 10 to about 30% of the total height of the cooling panel, more preferably about 20 to about 25% of the total height of the cooling panel. If an event occurs, this preferred release notch 60 is capable of directionally venting hot oil and gases in a rapid and controlled manner.

This preferred release notch 60 is also designed to have low inherent corrosion susceptibility and thus will not shorten the life of the transformer due to corrosion. Thus, unlike the release point described in U.S. Pat. No. 8,717,134 to Pintgen et al., which is located at the base of the tank and simply ruptures at this weaker joint, causing the fluid in at least the cooling panel portion of the transformer system to be rapidly released into the enclosure, the present invention provides a controlled and progressive release at the preferential point 60 at the base of the heat exchanger 30. It is also preferred that the transformer system 10 utilizes the preferred release notch 60 on at least one heat exchanger 30 in the transformer system.

The transformer system 10 described herein may also comprise additional features for monitoring the transformer system. For example, the transformer system 10 may comprise one or more temperature gauges and pressure gauges to monitor conditions in the transformer system.

The transformer system can also be optimized based on the average weather in the area where it will be installed. For example, if the weather is routinely very hot, such as in the southern part of the United States, or if the weather routinely gets very cold (i.e., below zero) in the winter time, the type of oil and/or monitoring requirements may be optimized as required.

In one embodiment, the temperature of the tank 20 is maintained within a range of about ambient to about 120° C.

Another optional feature of the invention is another release point, such as a pressure relief disc or pressure relief valve that fits into the headspace of the tank. The pressure relief valve or disc is designed to open at an earlier pressure level (for example 80% of the maximum or rupture pressure) so as to avoid a catastrophic event. Thus if the pressure in the transformer tank begins to rise to a critical level, the pressure relief disc can be set to rupture at a predetermined point and thus avoid a catastrophic event.

Various configurations of the transformer tank described herein can be assembled. For example, a transformer system may be configured to provide full containment of an internal arcing event with an energy range from about 10 MJ to about 25 MJ. In this instance the transformer system described herein does not have a preferred release point. In another embodiment, the transformer system may be configured to contain at least one of the pressure relief disc or the preferred release point described above.

The transformer tank 20 of the present invention may also include further design features to further contain a catastrophic event and further assure that hardware and other components would not be expelled from the tank during a catastrophic rupture thereof. One potential weak spot of the transformer tank is the tank cover 24. While the cover 24 is welded on, a catastrophic event may cause the weld 35 to fail, which could cause the cover 24 to blow off the tank 20, with potentially disastrous results. Thus, it is desirable in some embodiments to include additional features in the tank design that would cause the tank cover 24 to resist being blown off or ruptured.

Figure 7:
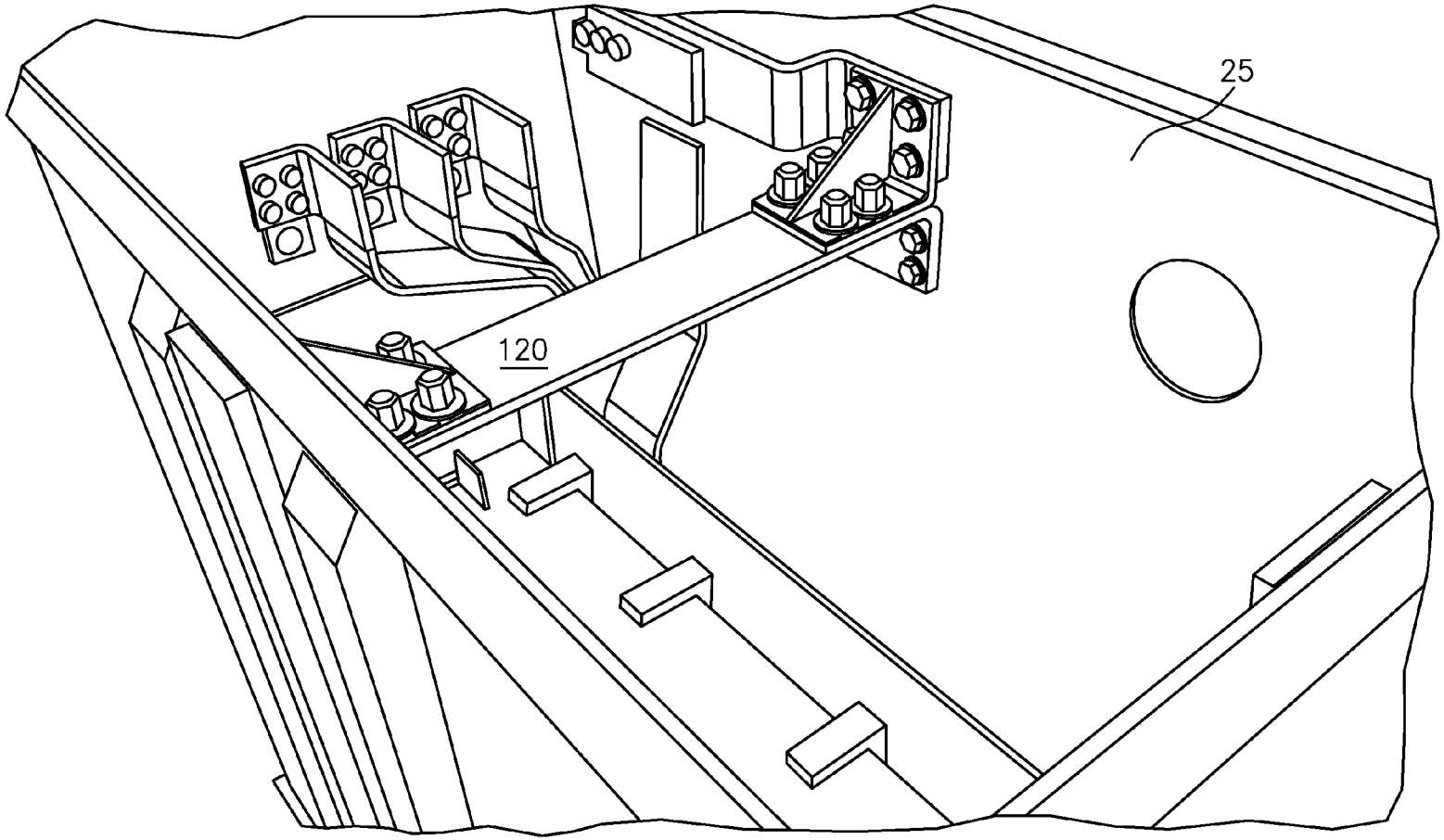
FIG. 7 depicts a view of a horizontal stiffener in accordance with an embodiment of the present invention.

For example, as shown in FIG. 7, the transformer tank 20 may include a horizontal stiffener 120 that is permanent fastened across a width of the transformer tank 20 above the core and coil assembly 80. The horizontal stiffener 120 maintains the integrity of the upper edge of the tank 20 to prevent the cover 24 of the tank 20 from blowing off or rupturing during a catastrophic event. In one preferred embodiment, the horizontal stiffener 120 is permanently fastened by bolting the horizontal stiffener 120 to an inside wall 25 of the transformer tank 20. The horizontal stiffener 120 must have sufficient ductility to flex along a length thereof to contain the event while at the same time having sufficient strength to resist breaking.

Figure 8:
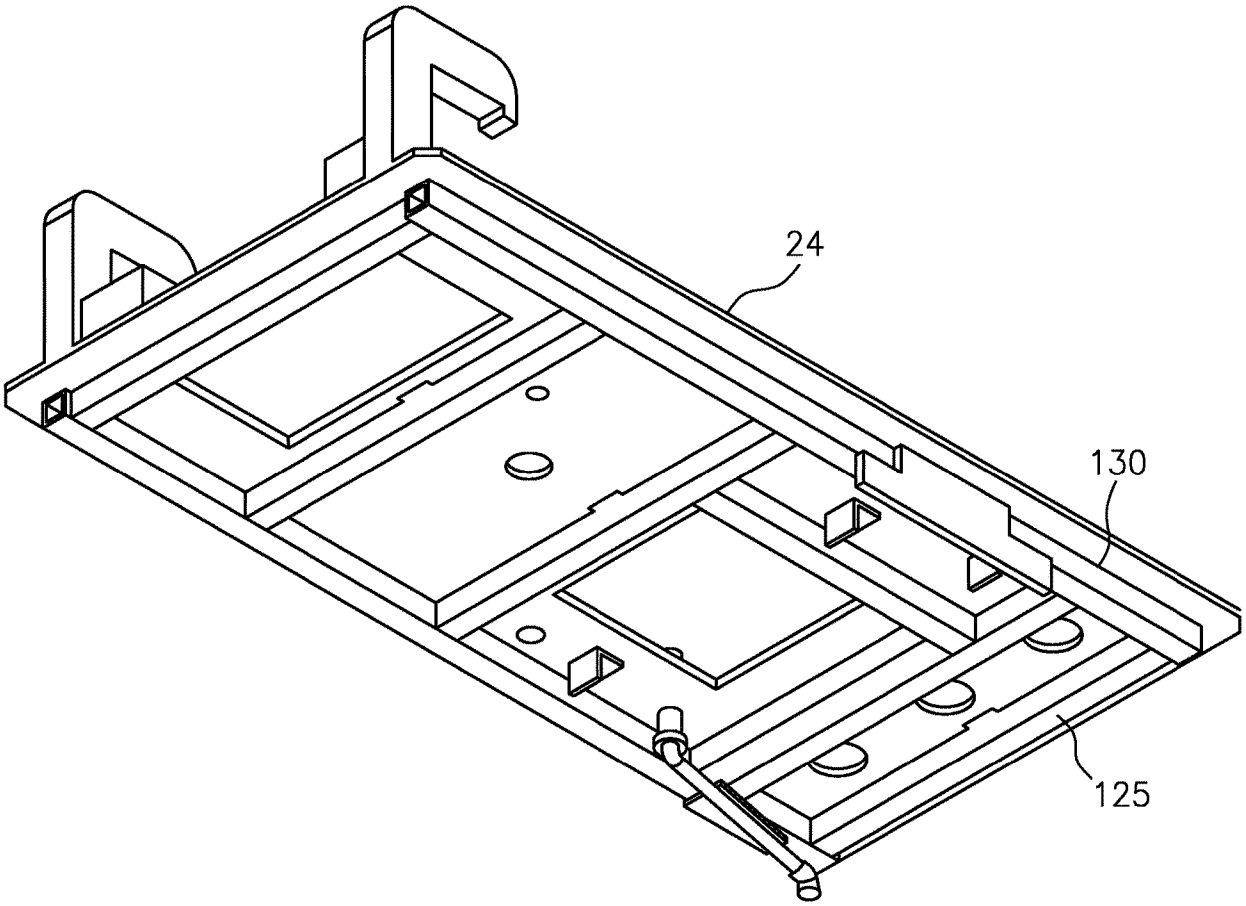
FIG. 8 depicts a view of the transformer tank cover in accordance with an embodiment of the present invention.

In addition, the cover 24 itself may be designed to include a network of stiffeners on an underside thereof as shown in FIG. 8. By including the network of stiffeners 125 and 130 on the underside of the cover 24, the cover 24 is prevented from flexing and bending that would cause the weld 35 to loosen and the cover 24 to blow off or rupture. The particular configuration of the network of stiffeners 125 and 130 would depend on the configuration of the tank 20.

In another embodiment, the transformer may optionally further comprise a rigid energy absorbing material such as an open-celled foam that can be effective in absorbing high-energy forces in that these foams will structurally deform their cells (i.e., collapse) upon impulse pressurization and thus limit the transfer of energy beyond the foam. These open-celled foams typically include a large plurality of small oil or fluid-filled spaces or cells connected together via a plurality of small rods to form open polygonal structures such as, for example, pentagons or hexagons, or a more random interconnected fibrous structure. These rigid open-celled foam materials may be characterized, for example, by the material of the rods, the relative density of the foam, the cell shapes, etc. as would be understood by one skilled in the art.

In the instant case of their use in a transformer tank, the open-celled foams absorb energy and collapse when the pressure in the transformer tank approaches the rupture pressure of the tank, thus providing an additional means of containing a potentially catastrophic event. The open-celled foams may have rods comprised substantially of aluminum or an aluminum alloy. Although aluminum and aluminum alloys are generally preferred, other metallic alloys, such as nickel and copper alloys may also be used in the practice of the invention. Non-metallic materials such as ceramics, rigid polymers, and carbon may also be used.

The energy absorbing material described herein may include a plurality of layers of the open-celled foam, and may include various layers of open-celled foam having different characteristics or materials in order to better contain and absorb the forces of a catastrophic event. In particular, the size, location, and energy absorbing characteristics of the layers within the tank may be varied. For example, different layers may be fabricated from different open-celled foams, from foams of a different relative density, from foams of a different thickness and/or from foams with different crushing characteristics. Moreover, the layers may be layered upon one another in a particular sequence for enhancing the energy and force absorbing characteristics of the tank. The choice and arrangement of the particular energy absorbing material within the tank would be within the skill of one skilled in the art and would be a matter of design choice depending in part on the size and location of the tank as well as the particular use of the transformer.

While the present invention has been described relative to network transformers and distribution transformers, the invention described herein is not limited to these applications but is also applicable to other types of transformers and similar applications in which it is desirable to transfer electrical power between and among two or more circuits.

For example, pole-mounted transformers are mounted on an electric service pole and are used to convert distribution voltage to the 120/240 volt power used by homes and various low-volume commercial installations and the invention described herein would also be applicable to pole-mounted transformers. Furthermore, pad-mount transformers, large transmission, distribution, and generation transformers, as well as shunt reactors, phase converters, and voltage regulators are also subject to catastrophic internal electrical arcing events and the invention described herein would also be applicable to improving the design of these devices.

EXAMPLES

Example 1. 500 kVA Transformers

The 500 kVA transformer was selected for initial development. Static hydraulic rupture testing was conducted with the following objectives:

1) Determine the withstand pressure capabilities of complete tank and cooling panel combination;
2) Determine the withstand pressure capabilities of tank accessories and components; and
3) Determine the withstand pressure capacity of the cooling panels with the release feature.
4) Test re-designed components to withstand a static pressure of approximately 200 psi Some of the design changes included:

1) enhanced structural stiffening of tank covers, tank flanges, tank sides and/or cooling panels; and
2) modified welding procedures and welding materials.

Static testing was conducted with 316L stainless steel and carbon steel assemblies. Filling the tank with water and comparing the empty and filled weight determined the tank volume before and after testing. The calculated volume change that was achieved during static pressure testing was in the range of about 25% to about 30%.

Testing of network transformer accessories was also undertaken. These tests were conducted within a heavily reinforced welded carbon steel tank. Testing included the following components individually:

LV bushings;
HV bushings;
Oil level gauge;
Thermometer well;
Tap changer; and
Ground switch shaft and flange.

Each of these components was subjected to a nominal pressure of 200 psi, with some testing up to 259 psi and 305 psi, in concert with the design test pressure for the tanks, and no leaks or failures of any of the components were observed.

Static hydraulic testing of isolated cooling panels was also conducted and static hydraulic testing of the preferred release point design proved satisfactory. The design was implemented in transformers that were subjected to full-scale under-oil arc testing.

For development of a 500 kVA transformer able to withstand a catastrophic event, four rounds of full-scale under-oil arcing tests were conducted at an independent high power laboratory. All of the tests were conducted with the test transformer mounted within a steel containment structure. The containment structures were specifically designed and built for the purpose of containing the test transformer oil and any components that might have been ejected during an uncontained event. Each transformer tank had one cooling panel welded to each of the long sides. These panels included a pressure release notch installed at its bottom edge that was designed to withstand approximately 10 MJ of arc energy without rupturing.

Power was supplied to the tank structure through three 600 A, 15 kV rated dead-break connectors installed on the transformer tank cover. Each transformer tank was solidly grounded internally to its containment tank. The dielectric fluid used during testing was Cargill's Envirotemp® (FR3).

Since the presence of the core and coil assembly inside the transformer tank presented certain conditions for the pressure wave reflection and/or absorption, the decision was made to use an actual core and coil assembly instead of a hard surfaced object or some other core and coil simulated object.

Many under-oil arcing tests were conducted for development purposes, culminating with five final tests. The energy levels ranged from 6.6 MJ to 13.4 MJ. Onset of the preferred release notch rupture was determined to be 9.4 MJ and release was confirmed to be progressive with increasing energy levels. The results are summarized in Table 1.

TABLE 1

Full-Scale Arcing Test Performance of 500 KVA Transformer Design

| Energy Level, MJ | Preferred Release Point Performance | Overall Tank Performance |
|---|---|---|
| 6.6 | No release | No leaks or ruptures |
| 9.4 | Pinhole | No leaks or ruptures |
| 10.6 | Small leak | No leaks or ruptures |
| 11 | Major leak | No leaks or ruptures |
| 13.4 | Major leak | No leaks or ruptures |

For all of the tests, it was observed that the transformer tanks and cooling panels expanded in a controlled manner. Transient pressures reached during these tests exceeded 900 psi. As required, expansion of the cooling panels was limited in such a manner that they would not have contacted the transformer vault walls.

Example 2. 1000 kVA Transformers

Static hydraulic testing was conducted and the nominal pressure withstand goal was set at 200 psi, as established during testing of the 500 kVA design. Pressurization was accomplished as described in Example 1.

Six 1000 kVA units were tested at various under-oil arcing energy levels. These tanks included the preferred release point design described herein. At higher energy levels achieved during these full-scale tests, the release point functioned as designed. All testing was conducted on transformers that included core and coil assembles. Each of these units was equipped with piezoelectric transducers that recorded transient pressures in the headspace, as well as under the oil in the transformer tank, and in the cooling panel. The test current and voltage were measured directly in the test cell at the test transformer feeder cables with calibrated instruments.

The 1000 kVA design included a preferred release point consisting of an inverted V-notch located at the bottom edge of the outer panel of the cooling panel assembly as described in Example 1. Consistent with the design of the 500 kVA units, the gap between the panels along the notch was filled with a thin gauge 316L stainless steel liner welded with 309 stainless steel MIG wire.

The same structural design elements, welding materials and practices, and other enhancements that were developed during the 500 kVA transformer development were applied to the 1000 kVA tank and cooling panel designs. Consistent with the testing performed on the 500 kVA design, an actual core and coil assembly was mounted inside the transformer tank to simulate operating conditions.

Full-scale under-oil arcing tests were conducted across an energy range from 3.9 MJ to 23.2 MJ for testing of the preferred release design. The results of these tests are summarized in Table 2 for the 1000 kVA transformer design.

TABLE 2

Full-Scale Arcing Test Performance of 1000 kVA Transformer Design

| Energy Level, MJ | Preferred Release Point Performance | Overall Tank Performance |
|---|---|---|
| 3.9 | No leaks | No ruptures or leaks |
| 13.4 | Small leak | No ruptures or leaks |
| 13.6 | Small leak | No ruptures or leaks |
| 15.2 | No leak | No ruptures or leaks |
| 19.5 | Small leak | No ruptures or leaks |
| 23.2 | Major leak | No ruptures or leaks |

No visual evidence of any fires, expelled flaming liquid, or explosion of oil vapor were observed on any test unit. Fluid from the cooling panel release points did not reach the elevation of the transformer cover. In all instances, the fluid discharge was directed downward, as intended by the design.

While the present invention has been described in terms of its preferred use in providing a transformer system that is capable of withstanding a catastrophic event and at least substantially minimizing and controlling any rupture or breach of such a transformer system resulting from the catastrophic event, it is also believed that the present invention has broader utility in controlling excessive pressures in other systems containing a tank and a heat exchanger. Based thereon, the present invention also relates generally to a rupture resistant system comprising:

a) a tank comprising a plurality of sidewall members, a tank cover and a bottom member joined together to form an enclosure capable of containing a fluid therein; and b) at least one heat exchanger connected to the tank, wherein the at least one heat exchanger comprises at least one hollow panel;

wherein as the fluid in the tank increases in temperature and expands within the tank, the fluid is cooled by circulating the fluid through the at least one hollow panel in the at least one heat exchanger; and wherein, the tank and the at least one heat exchanger are capable of expanding in volume to contain energy resulting from a sudden generation of gases which increases the pressure inside the tank.

Finally, it should also be understood that the following claims are intended to cover all of the generic and specific features of the invention described herein and all statements of the scope of the invention that as a matter of language might fall there between.

What is claimed is:

1. A transformer system comprising:

a) a transformer tank, wherein the transformer tank comprises a plurality of sidewall members, a tank cover, and a bottom member joined together to form an enclosure for housing a transformer coil and core assembly therein, and wherein the enclosure contains a dielectric fluid that is capable of electrically insulating components of the transformer coil and core assembly; and b) at least one heat exchanger connected to the transformer tank, wherein the at least one heat exchanger comprises at least one hollow panel or radiator;

wherein as the dielectric fluid increases in temperature and expands within the tank, the dielectric fluid is cooled by circulating the dielectric fluid through the at least one hollow panel or radiator in the at least one heat exchanger; and wherein the transformer tank and the at least one heat exchanger are capable of expanding in volume to contain up to 25 megajoules of electric arc fault energy that produces a sudden generation of gases which increases the pressure inside the transformer tank without rupturing and while maintaining the integrity of the at least one heat exchanger.

2. The transformer system according to claim 1, wherein the transformer tank and the at least one heat exchanger are capable of expanding in volume by at least 15%.

3. The transformer system according to claim 2, wherein the transformer tank and the at least one heat exchanger are capable of expanding in volume by at least 30%.

4. The transformer system according to claim 1, wherein the sidewalls and the tank cover are capable of expanding in volume to contain the energy resulting from the sudden internal generation of gases.

5. The transformer system according to claim 1, wherein bottom member is rigid and does not flex significantly when the transformer tank and the at least one heat exchanger expand in volume.

6. The transformer system according to claim 5, wherein the bottom member further comprises I-beams or other structural profiles welded thereto, wherein the I-beams support the tank and provide rigidity.

7. The transformer system according to claim 1, wherein the heat exchanger comprises a hollow panel and a plurality of constraints, said plurality of constraint being capable of minimizing deformation of the heat exchanger when the heat exchanger expands in volume.

8. The transformer system according to claim 7, wherein the plurality of constraints comprises a plurality of rivets connecting a first side of the hollow panel to a second side of the hollow panel.

9. The transformer system according to claim 7, wherein the plurality of constraints do not yield or fail when the heat exchanger expands in volume.

10. The transformer system according to claim 1, wherein transformer system is capable of providing full containment of a catastrophic event with no leaks or ruptures.

11. A rupture resistant system comprising:

a) a tank comprising a plurality of sidewall members, a tank cover and a bottom member joined together to form an enclosure capable of containing a fluid therein; and b) at least one heat exchanger connected to the tank, wherein the at least one heat exchanger comprises at least one panel;

wherein as the fluid in the tank increases in temperature and expands within the tank, the fluid is cooled by circulating the fluid through the at least one hollow panel in the at least one heat exchanger; and wherein the tank and the at least one heat exchanger are capable of expanding in volume to contain up to 25 megajoules of electric arc fault energy that produces a sudden generation of gases which increases the pressure inside the tank without rupturing, and wherein the heat exchanger comprises a plurality of constraints, said plurality of constraints being capable of minimizing deformation of the heat exchanger when the heat exchanger expands in volume.

12. The rupture resistant system according to claim 11, wherein the plurality of constraints comprise a plurality of rivets connecting a first side of the hollow panel to a second side of the hollow panel.

13. The rupture resistant system according to claim 11, wherein the plurality of constraints do not yield or fail when the heat exchanger expands in volume.

14. The rupture resistant system according to claim 11, wherein the rupture resistant system is capable of providing full containment of a catastrophic event with no leaks or ruptures.

15. A transformer system comprising:

a) a transformer tank, wherein the transformer tank comprises a plurality of sidewall members, a tank cover, and a bottom member joined together to form an enclosure for housing a transformer coil and core assembly therein, and wherein the enclosure contains a dielectric fluid that is capable of electrically insulating components of the transformer coil and core assembly;

b) at least one heat exchanger connected to the transformer tank, wherein the at least one heat exchanger comprises at least one hollow panel or radiator;

c) a preferred release notch, wherein the preferred release notch comprises a wedge piece that is welded between a notched lower edge of a first side and a second side of the hollow panel, and wherein the wedge piece tapers to a tip at an upper edge of the preferred release notch between the first side and the second side, wherein as the dielectric fluid increases in temperature and expands within the tank, the dielectric fluid is cooled by circulating the dielectric fluid through the at least one hollow panel or radiator in the at least one heat exchanger; and wherein when the dielectric fluid becomes heated and a pressure inside the transformer system exceeds a rupture pressure of the transformer system of at least about 10 MJ, a controlled pressure release preferentially initiates at the upper edge of the preferred release notch of the heat exchanger, where the preferred release notch is capable of providing a progressive opening that can gradually widen as the pressure Intensifies, wherein the transformer tank and the at least one heat exchanger are capable of expanding in volume to contain up to 25 megajoules of electric arc fault energy that produces a sudden generation of gases which increases the pressure inside the transformer tank while maintaining the integrity of the at least one heat exchanger.

16. The transformer system according to claim 15, wherein the plurality of constraints comprise a plurality of rivets and the spacing of the rivets concentrates mechanical stresses at the tip of the preferred release notch to preferentially initiate any pressure release at the tip at the upper edge of the preferred release notch.

17. The transformer system according to claim 15, wherein an angle of the notch as measured from the tip at the upper edge of the preferred release notch is between about 40° and about 70°.

18. The transformer system according to claim 17, wherein an angle of the notch as measured from the tip at the upper edge of the preferred release notch is between about 50° and about 60°.

19. The transformer system according to claim 15, wherein a height of the notch as measured from the lower edge of the hollow panel is between about 10% and about 30% of the height of the heat exchanger.

20. The transformer system according to claim 19, wherein a height of the notch as measured from the lower edge of the hollow panel is between about 20% and about 25% of the height of the heat exchanger.

21. The transformer system according to claim 15, wherein the transformer tank and the heat exchanger comprise carbon steel and the wedge piece and the weld between the wedge piece and the first side and second side of the hollow panel comprises stainless steel.

22. A rupture resistant system comprising:

a) a tank comprising a plurality of sidewall members, a tank cover and a bottom member joined together to form an enclosure capable of containing a fluid therein; and b) at least one heat exchanger connected to the tank, wherein the at least one heat exchanger comprises at least one hollow panel;

c) a preferred release notch, wherein the preferred release notch comprises a wedge piece that is welded between a notched lower edge of a first side and a second side of the hollow panel, and wherein the wedge piece tapers to a tip at an upper edge of the preferred release notch between the first side and the second side, wherein as the fluid in the tank increases in temperature and expands within the tank, the fluid is cooled by circulating the fluid through the at least one hollow panel in the at least one heat exchanger; and wherein when the dielectric fluid becomes heated and a pressure inside the rupture resistant system exceeds a rupture pressure of the transformer system of at least about 10 MJ, a controlled pressure release preferentially initiates at the upper edge of the preferred release notch of the heat exchanger, where the preferred release notch is capable of providing a progressive opening that can gradually widen as the pressure intensifies, wherein the transformer tank and the at least one heat exchanger are capable of expanding in volume to contain up to 25 megajoules of electric arc fault energy that produces a sudden generation of gases which increases the pressure inside the transformer tank while maintaining the integrity of the at least one heat exchanger.

23. The rupture resistant system according to claim 22, wherein the heat exchanger comprises a plurality of constraints, and wherein the plurality of constraints comprise a plurality of rivets and the spacing of the rivets concentrates mechanical stresses at the tip of the preferred release notch to preferentially initiate any controlled pressure release at the tip at the upper edge of the preferred release notch.

* * * * *